US007479047B2

(12) United States Patent
Boischio

(10) Patent No.: US 7,479,047 B2
(45) Date of Patent: Jan. 20, 2009

(54) ASSEMBLY FOR CONNECTING THE STATOR WINDINGS OF AN ELECTRIC MOTOR TO THE RESPECTIVE POWER SUPPLY

(75) Inventor: Ido Boischio, Padua (IT)

(73) Assignee: INARCA S.p.A., Vigodarzere (IT)

( * ) Notice: Subject to any disclaimer, the term of this patent is extended or adjusted under 35 U.S.C. 154(b) by 0 days.

(21) Appl. No.: 11/905,424

(22) Filed: Oct. 1, 2007

(65) Prior Publication Data

US 2008/0026617 A1 Jan. 31, 2008

(30) Foreign Application Priority Data

Oct. 3, 2006 (IT) ..... PD2006A0362

(51) Int. Cl.
*H01R 13/432* (2006.01)

(52) U.S. Cl. ..... 439/746; 310/71

(58) Field of Classification Search ..... 439/746, 439/857, 858; 310/71
See application file for complete search history.

(56) References Cited

U.S. PATENT DOCUMENTS 3,173,737 A * 3/1965 Kinkaid et al. ..... 439/637
5,816,861 A 10/1998 Cheng
5,975,937 A * 11/1999 Boischio ..... 439/404
2008/0093940 A1 * 4/2008 Boischio ..... 310/71

FOREIGN PATENT DOCUMENTS

EP 0 837 542 A 4/1998

* cited by examiner

*Primary Examiner*—Hae Moon Hyeon
(74) *Attorney, Agent, or Firm*—Modiano & Associati; Albert Josif; Daniel J. O'Byrne

(57) ABSTRACT

An assembly for connecting the stator windings of an electric motor to the respective power supply, that has a first box-like connector with first internal passages open at their ends to accommodate corresponding first electrical terminals, the first connector being provided with an engagement for the stator which is adapted to arrange the first passages parallel to the axis of the electric motor; at least one second box-like connector with second internal passages open at their ends to accommodate corresponding second electrical terminals for coupling to the first electrical terminals; and an adapter module for connecting the first connector to the second connector and comprising a third intermediate connector, which has a first part to be coupled in a cavity formed at the end part of the first internal passages and a second internal part for stably accommodating the second connector.

7 Claims, 4 Drawing Sheets

ASSEMBLY FOR CONNECTING THE STATOR WINDINGS OF AN ELECTRIC MOTOR TO THE RESPECTIVE POWER SUPPLY

The present invention relates to an assembly for connecting the stator windings of an electric motor to the respective power supply.

BACKGROUND OF THE INVENTION

As is known, the connection of the stator windings of an electric motor to the respective power supply can occur manually, or, as in recent times and in the case of a large number of connections, in an automated manner.

Automated connection provides for the use of a first box-like connector made of plastic material, which is fixed to the stator and which accommodates internally, in respective passages, first electrical terminals to which wires connected to the windings are crimped, and a second box-like connector, inside which there are second electrical terminals to which the wires connected to the power supply are crimped; the first connector is coupled stably to the second connector and the respective terminals are also coupled.

Automatic machines for assembling this connection are generally dedicated to the type of connector used.

In general, the coupled connectors belong to a same standardized modular series.

In studying a new design of a product provided with an electric motor, it may be necessary, for example due to the sudden unavailability of a supplier, to couple connectors of different modular series; in this case, the only solution is to renounce one of the two connectors of the standard type used previously, with consequent problems related to the need to redesign or retool the assembly machines.

SUMMARY OF THE INVENTION

The aim of the present invention is to solve the above-mentioned drawbacks, by providing a connection assembly which allows to connect connectors of different modular series.

Within this aim, an object of the present invention is to provide an assembly for connecting the stator windings of an electric motor to the respective power supply.

Another object of the present invention is to provide an assembly for connecting the stator windings of an electric motor to the respective power supply which can be manufactured with known technologies and machines.

This aim and these and other objects, which will become better apparent hereinafter, are achieved by an assembly for connecting the stator windings of an electric motor to the respective power supply, characterized in that it comprises:

- a first box-like connector provided with first internal passages which are open at their ends and are designed to accommodate corresponding first electrical terminals, said first connector being provided with means for engaging the stator which are adapted to arrange said passages parallel to the axis of the electric motor,
- at least one second box-like connector provided with second internal passages which are open at their ends and are designed to accommodate corresponding second terminals for coupling to said first electrical terminals,
- an adapter module, which is suitable to connect said first connector to said second connector and comprises a third intermediate connector, which has a first part to be arranged by coupling in a cavity formed at the end part of said first internal passages and a second part for stably accommodating said second connector.

BRIEF DESCRIPTION OF THE DRAWINGS

Further characteristics and advantages of the invention will become better apparent from the following detailed description of some preferred but not exclusive embodiments thereof, illustrated by way of non-limiting example in the accompanying drawings, wherein.

DESCRIPTION OF THE PREFERRED EMBODIMENTS

Figure 1:
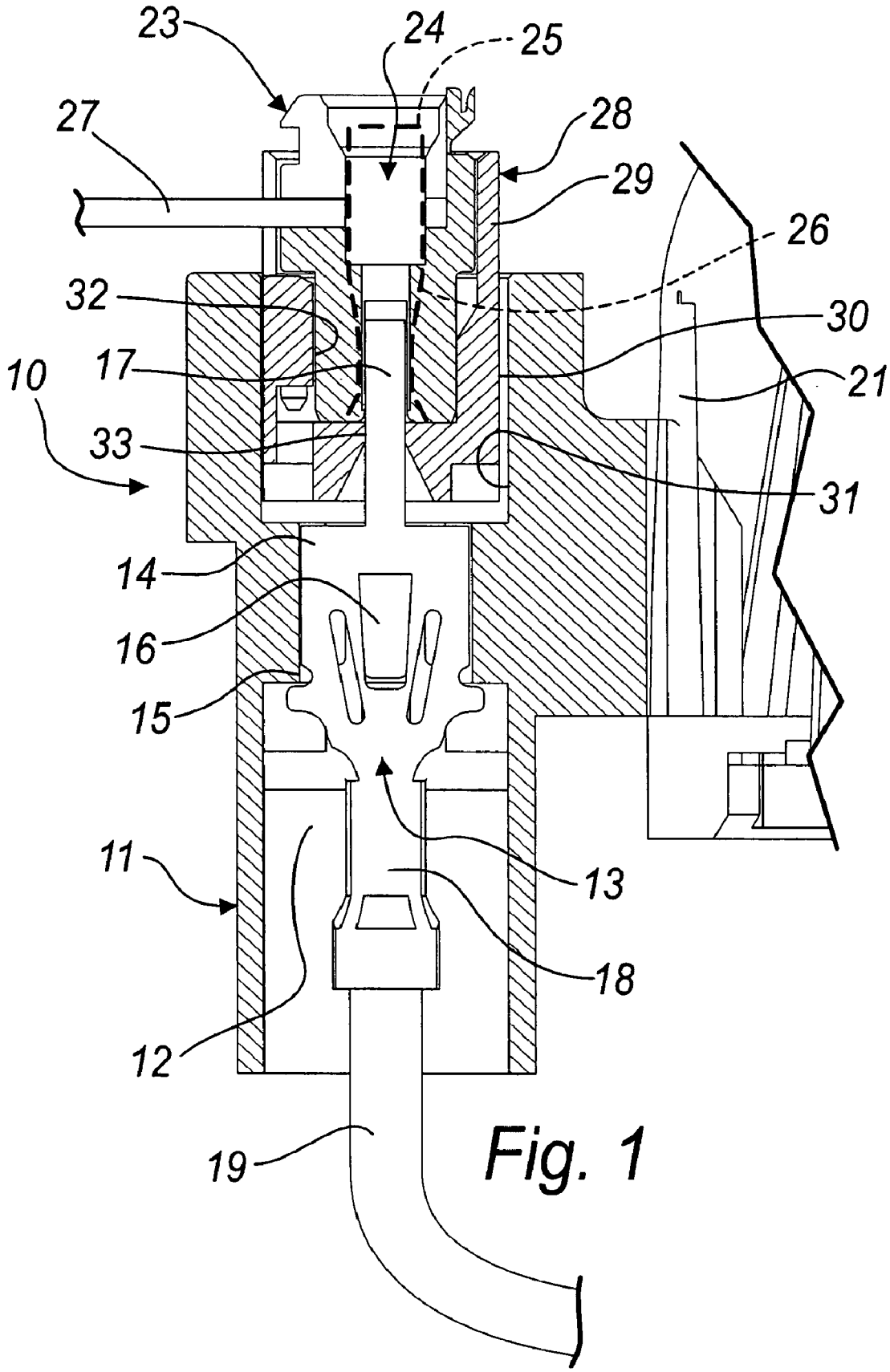
FIG. 1 is a sectional side view of a connection assembly according to the invention in a first embodiment.
Figure 3:
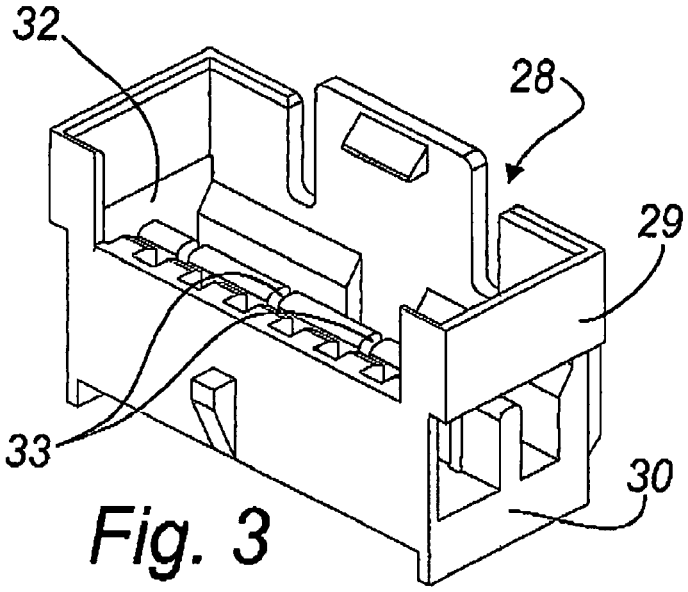
FIG. 3 is a perspective view of a module which provides the connection assembly of FIG. 1.
Figure 4:
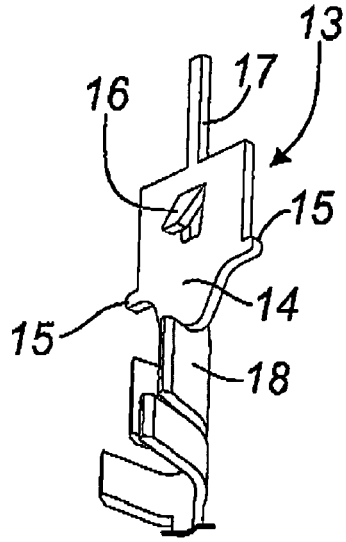
FIG. 4 is a perspective view of a male terminal used in the connection assembly of FIG. 1.

It is noted that anything found to be already known during the patenting process is understood not to be claimed and to be the subject of a disclaimer.

With reference to FIGS. 1 to 4, a first assembly for connecting the stator windings of an electric motor to the respective power supply according to the invention is generally designated by the reference numeral 10.

The connection assembly 10 comprises a first box-like connector 11, which is provided with first internal passages 12 which are open at their ends and are designed to accommodate corresponding first male electrical terminals 13.

In particular, the first male electrical terminals 13 are constituted by a central flat body 14 which has a quadrangular contour and is provided laterally with two mutually opposite abutments 15 for limiting the insertion stroke in the corresponding first internal passage 12 and centrally with a tooth 16 which is adapted to prevent extraction from the corresponding internal passage 12.

A strip 17 protrudes from the central flat body 14 and provides the portion to be placed in contact with a corresponding electrical terminal, which is described hereinafter.

A portion 18 for crimping to a corresponding wire 19 connected to the stator windings (not shown in the figures) protrudes from the central flat body 14 on the opposite side with respect to the central strip 17.

Figure 2:
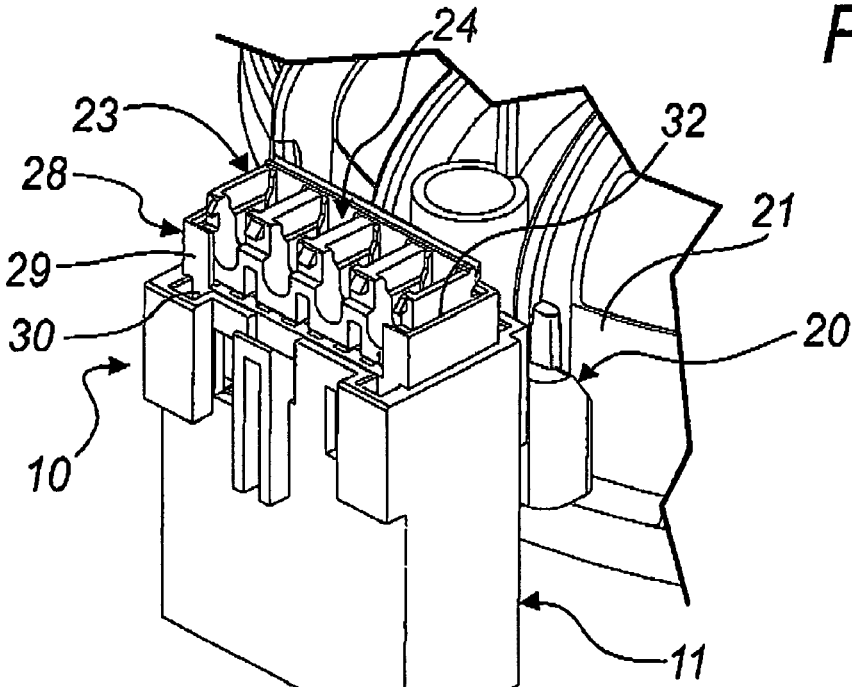
FIG. 2 is a perspective view of the connection assembly of FIG. 1.

The first connector 11 is provided with means 20 for engaging the stator, which are not described in detail since they are substantially of a known type, such as for example means for snap or interference coupling with portions of a dome made of plastic material, designated by the reference numeral 21 in FIGS. 1 and 2, for covering the stator.

The engagement means 20 are configured so as to arrange the first internal passages 12 parallel to the axis of the electric motor.

Figure 5:
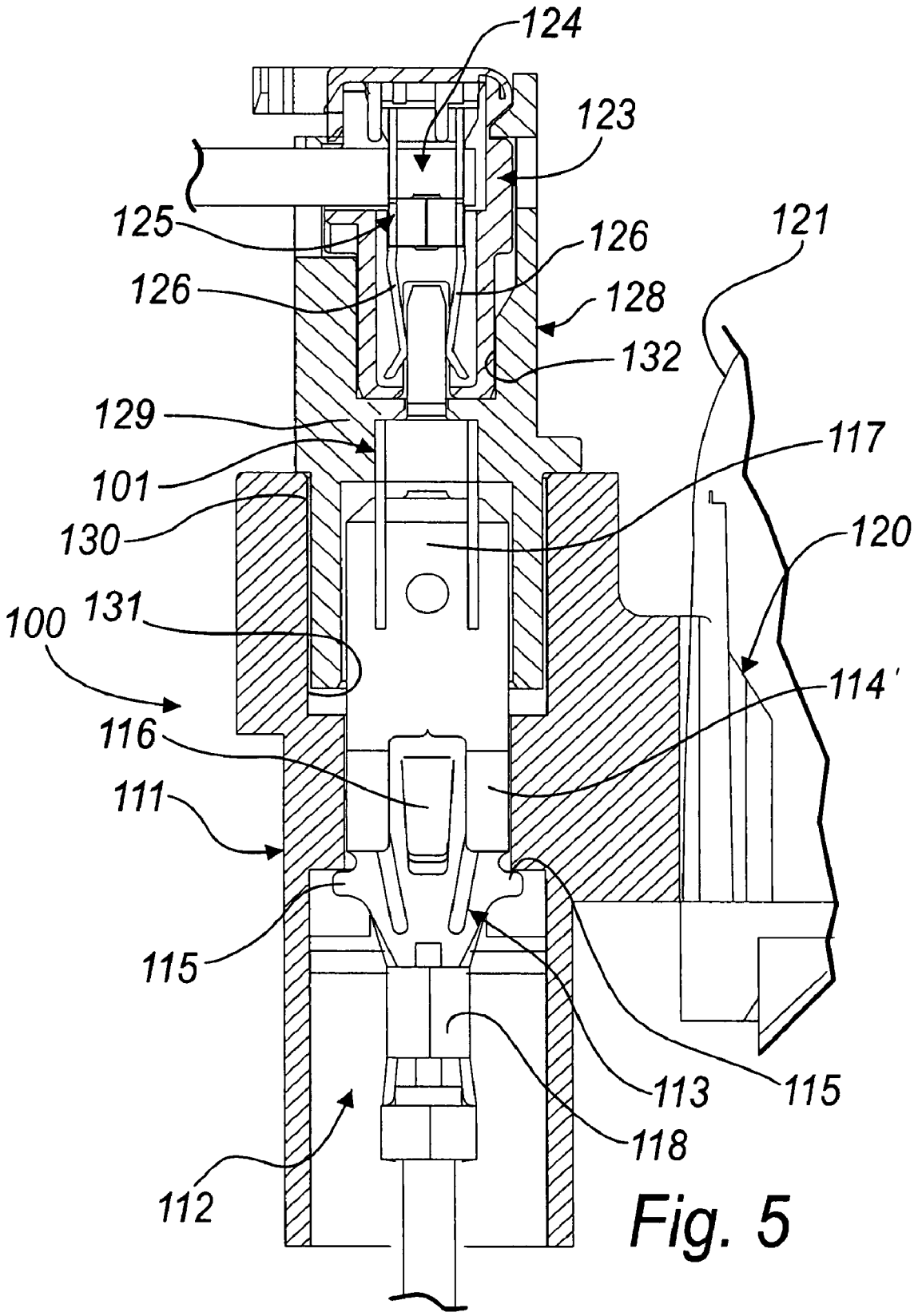
FIG. 5 is a sectional side view of a connection assembly according to the invention in a second embodiment.

The connection assembly also comprises at least one second box-like connector 23 provided with second internal passages 24, which are open at their ends and are designed to accommodate corresponding second female terminals 25, which are coupled to the first male electrical terminals 13 (in FIG. 1, the second female terminals 25 are shown schematically by means of broken lines; the second connector and the second female terminals are shown in FIG. 5 with reference to a second embodiment and are designated therein respectively by the reference numerals 123 and 125).

As can be seen, the second internal passages 24 are aligned with the first internal passages 12.

The second female electrical terminals 25 have a portion for connection to the first male terminals 13 which consists of a pair of mutually opposite metallic wings 26, which clamp the strip 17 of the male terminals 13 and are connected to a wire 27 which is connected to the power supply of the motor.

As clearly shown in the figures, the connection assembly 10 further comprises an adapter module 28, which allows to connect the first connector 11 to the second connector 23.

The first connector and the second connector in fact belong to different modular standardized series.

The adapter module 28 comprises a third intermediate connector 29, which is provided with a first external part 30, to be arranged by coupling in a cavity 31 which is formed at the end part of the first internal passages 12, and a second internal part 32 for stably accommodating the second connector 23.

In this embodiment, the contour shape of the first part 30 contains in practice the contour shape of the second part 32, so that part of the second connector 23 lies inside the volume that forms the cavity 31 of the first connector 11.

Conveniently, the third connector 29 is provided with through openings 33 which are aligned with the first and second internal passages 12 and 24.

In practice, the first part 30 is shaped or contoured so as to couple to the first connector 11, while the second part 32 is shaped or contoured so as to accommodate by coupling the second connector 23 (it is possible to insert in the second part 32 one or more second connectors arranged side-by-side, depending on the required connection configuration).

The through openings 33 allow connection between the male and female electrical terminals 13 and 25 associated with the first and second connectors 11 and 23.

In practice, the connection between two connectors of different modular series has been provided by means of a dedicated third connector.

Figure 7:
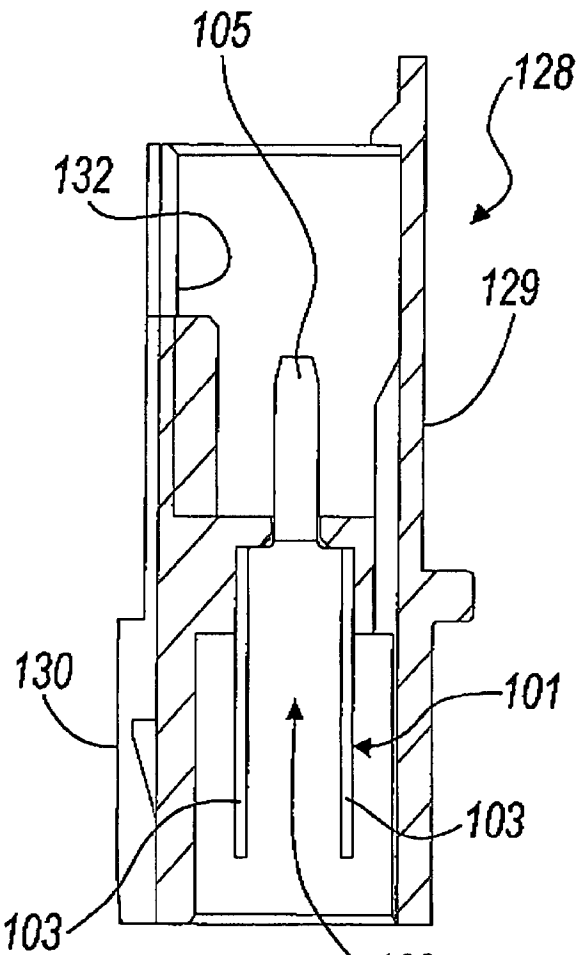
FIG. 7 is a sectional side view of a module which provides the connection assembly of FIG. 5.
Figure 6:
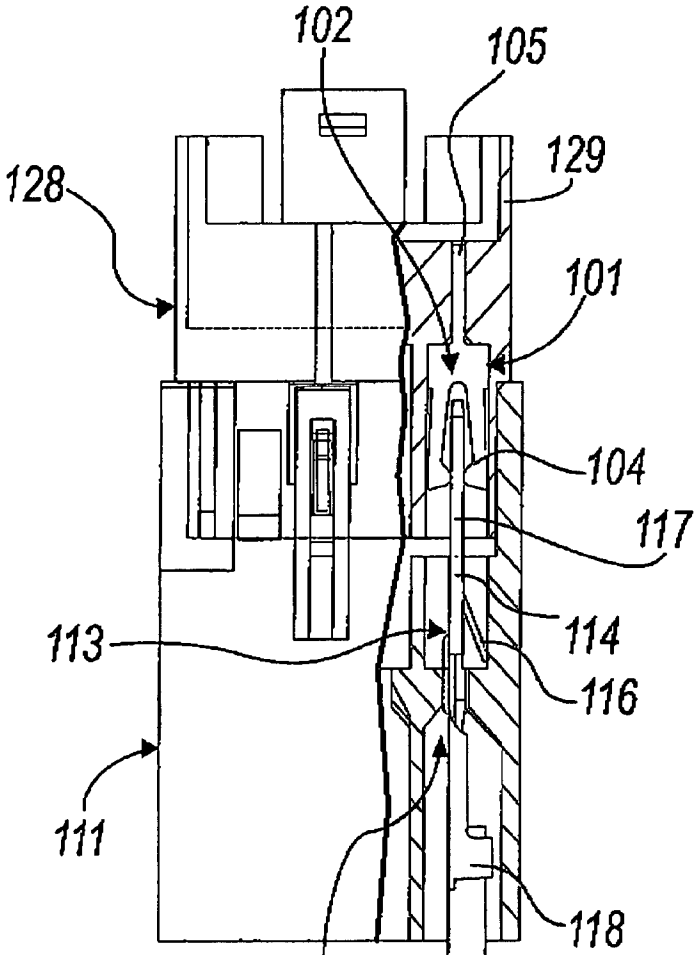
FIG. 6 is a partially sectional front view of part of the connection assembly of FIG. 5.

With reference to FIGS. 5 to 7, a second embodiment of a connection assembly according to the invention is generally designated by the reference numeral 100.

The connection assembly 100 comprises a first box-like connector 111 provided with first internal passages 112, which are open at their ends and are designed to accommodate corresponding first male electrical terminals 113.

In particular, the first male electrical terminals 113 are constituted by a flat body 114, which has a quadrangular contour and is provided laterally with two mutually opposite abutments 115 for limiting the insertion stroke in the corresponding first internal passage 112 and centrally with a tooth 116 which is adapted to prevent extraction from the corresponding internal passage 112.

One end 117 of the flat body 114 provides the portion to be placed in contact with a corresponding electrical terminal, which is described hereinafter.

A portion 118 for crimping to a corresponding wire 119 connected to the stator windings (not shown in the figures) protrudes from the opposite end of the flat body 114.

The first connector 111 is provided with means 120 for engaging the stator, which are not described in detail since they are substantially of a known type, such as for example means for snap or interference coupling with portions of a dome made of plastic material, designated by the reference numeral 121 in FIG. 5, for covering the stator.

The engagement means 120 are configured so as to arrange the first internal passages 112 parallel to the axis of the electric motor.

The connection assembly also comprises at least one second box-like connector 123 provided with second internal passages 124, which are open at their ends and are designed to accommodate corresponding second female terminals 125 to be connected electrically to the first male electrical terminals 113.

As can be seen, the second internal passages 124 are aligned with the first internal passages 112.

The second female electrical terminals 125 have a portion for connection to a respective electrical terminal, described hereinafter, which consists of a pair of mutually opposite metallic wings 126 which are adapted to clamp a corresponding electrical terminal, which is described hereinafter.

As clearly shown in the figures, the connection assembly 100 further comprises an adapter module 128, which allows to connect the first connector 111 to the second connector 123.

In this embodiment, the adapter module 128 comprises a third intermediate connector 129 (shown individually in FIG. 7), which has a first external part 130, to be arranged by coupling in a cavity 131 which is formed at the end part of the first internal passages 112, and a second internal part 132 for stably accommodating the second connector 123.

Differently from the previous embodiment, the contour of the first part 130 does not contain the contour of the second part 132, since one is spaced with respect to the other.

The first male electrical terminals 113 and the second female electrical terminals 125 are in electrical contact by way of the interposition of third electrical terminals 101, which are arranged in corresponding third internal passages 102 which are formed in the third connector 129 and are aligned with the first and second internal passages 112 and 124.

The third electrical terminals 101 comprise two symmetrical wings 103, each of which is provided centrally with a through slot 104 (see FIG. 6, which shows only the first connector 111 and the third connector 129) for accommodating with contact the end 117 of the corresponding flat body 114 of the first male terminals 113.

The two symmetrical wings 103 merge into a common pin 105, which is parallel, but oriented in the opposite direction, with respect to the direction for extraction from the Through slot 104.

The pin 105 is arranged in electrical contact between the wings 126 of the corresponding second female terminal 125.

In practice, the first part 130 of the third connector 129 is contoured so as to couple to the first connector 111, while the second part 132 is contoured so as to accommodate by coupling the second connector 123 (one or more second connectors arranged side-by-side, depending on the required connection configuration, can be inserted in the second part 132).

In practice it has been found that the invention thus described achieves the intended aim and objects.

By means of the present invention it is in fact possible to wire electric motors by means of connectors which belong to different modular series.

Moreover, the structures of the connection assembly according to the invention allow a wiring which is particularly stable and easy to assemble.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

What is claimed is:

1. A connector assembly for connecting stator windings of a stator of an electric motor to a respective power supply, comprising:

a first box-like connector provided with first internal passages, which are open at an end part thereof to accommodate corresponding first electrical terminals, said first connector being provided with engagement means for engaging the stator which are adapted to arrange said first passages parallel to an axis of the electric motor, at least one second box-like connector provided with second internal passages which are open at an end part thereof to accommodate corresponding second electrical terminals for coupling to said first electrical terminals, an adapter module, which is suitable to connect said first connector to said second connector and comprises a third intermediate connector, which has a first part to be arranged by coupling in a cavity formed at the end part of said first internal passages and a second internal part for stably accommodating said second connector.

2. The connection assembly of claim 1, wherein corresponding ones of said first internal passages and said second internal passages are mutually aligned.

3. The connection assembly of claim 1, wherein said first and second parts of the third connector have contour shapes such that the contour shape of said first part of said third connector contains the contour shape of said second part of said third connector, so that part of said second connector lies within a volume which forms said cavity of said first connector, said third connector having through openings which are aligned with said first and second internal passages.

4. The connection assembly of claim 1, wherein said first electrical terminals are each constituted by a central flat body, which has a quadrangular contour and is provided laterally with two mutually opposite abutments for limiting an insertion stroke in a corresponding said first internal passage, said flat body being further provided centrally with a tooth which is adapted to prevent extraction from the corresponding internal passage, said central body further having a portion for crimping to a corresponding wire connected to the stator windings that protrudes therefrom on an opposite side with respect to said central strip, said second electrical terminals having a portion for connection to said first male terminals which consists of a pair of mutually opposite metallic wings which clamp said strip of said first electrical terminals and are connected to the power supply of the motor.

5. The connection assembly of claim 2, wherein said first part of said third connector has a contour shape such as to be spaced from a contour shape of said second part of said third connector, so tat part of said second connector is external with respect to a volume which forms said cavity of said first connector.

6. The connection assembly of claim 5, wherein said adapter module comprises third electrical terminals which are accommodated in corresponding third internal passages formed in said third connector, said third internal passages being aligned with said first and second internal passages.

7. The connection assembly of claim 6, wherein said first electrical terminals are each constituted by a flat body which has a quadrangular contour and is provided laterally with two mutually opposite abutments for limiting an insertion stroke in the corresponding first internal passage, said flat body being centrally provided with a tooth which is adapted to prevent extraction from a corresponding one of said internal passages, one end of said flat body providing a portion to be placed in contact with a corresponding said third electrical terminal, said flat body further comprising a portion for crimping to a corresponding wire connected to the stator windings and protruding from the opposite end thereof, said third electrical terminals each comprising two symmetrical wings, each of which is provided centrally with a through slot for accommodating with contact an end of the corresponding flat body of a corresponding first terminal, said two symmetrical wings merging into a common pin which is parallel but oppositely oriented with respect to the direction for extraction from said through slot, said second electrical terminals having a portion for connection to the respective said third electrical terminal which consists of a pair of mutually opposite wings which are adapted to clamp said pin.

* * * * *